US007237777B2

(12) United States Patent
Digges, III et al.

(10) Patent No.: US 7,237,777 B2
(45) Date of Patent: Jul. 3, 2007

(54) BAG TOSS GAME TARGET ASSEMBLIES

(75) Inventors: Randolph E. Digges, III, North Olmsted, OH (US); Robert D. Murphy, North Olmsted, OH (US)

(73) Assignee: KT Games Inc., Cleveland, OH (US)

( * ) Notice: Subject to any disclaimer, the term of this patent is extended or adjusted under 35 U.S.C. 154(b) by 0 days.

(21) Appl. No.: 11/306,934

(22) Filed: Jan. 17, 2006

(65) Prior Publication Data

US 2006/0125186 A1 Jun. 15, 2006

Related U.S. Application Data

(60) Provisional application No. 60/596,250, filed on Sep. 11, 2005.

(51) Int. Cl.
*A63B 63/00* (2006.01)

(52) U.S. Cl. ..... 273/400

(58) Field of Classification Search ..... 273/398–402
See application file for complete search history.

(56) References Cited

U.S. PATENT DOCUMENTS

| | | | | |
|---|---|---|---|---|
| 285,396 | A | 9/1883 | De Windt | |
| 406,342 | A | 7/1889 | Dumont | |
| 922,717 | A * | 5/1909 | Parker | 273/401 |
| 1,636,920 | A | 7/1927 | Nichols | |
| 2,021,989 | A | 11/1935 | De Master | |
| 3,628,793 | A | 12/1971 | Mudloff | |
| 3,837,650 | A | 9/1974 | Haney | |
| 4,186,925 | A | 2/1980 | Goldfarb et al. | |
| 4,243,229 | A | 1/1981 | Huser et al. | |
| 4,565,375 | A | 1/1986 | Dresel | |
| 4,709,929 | A | 12/1987 | Mills et al. | |
| 4,938,485 | A | 7/1990 | Hockridge et al. | |
| 4,943,065 | A | 7/1990 | DeLapa | |
| 4,961,586 | A | 10/1990 | Conville | |
| 4,986,549 | A | 1/1991 | Kuhtic et al. | |
| 5,050,889 | A | 9/1991 | Walker | |
| 5,056,796 | A | 10/1991 | Conville | |
| 5,165,695 | A | 11/1992 | Yoder | |

(Continued)

OTHER PUBLICATIONS

"Official ACA Cornhole / Corn Toss Rules," printed from the Internet at http://www.playcornhole.org/rules.shtml on Jan. 21, 2006 (10 pages).

(Continued)

*Primary Examiner*—Mark S. Graham
(74) *Attorney, Agent, or Firm*—Randolph E. Digges, III

(57) ABSTRACT

Bag toss game target assemblies that include a deck and a base unit. The deck includes at least one through-aperture dimensioned to allow a bag to pass entirely therethrough. The base unit has a bottom portion that is configured to rest on a generally horizontal surface and a top portion that is configured to support the deck during game play. In one preferred embodiment, the base unit further includes an open-top storage receptacle that is covered by the deck during game play, but can be accessed by moving the deck independent of the base unit. In another preferred embodiment, the deck from at least target assembly can be removed from its corresponding base unit, and the corresponding base unit can be nested beneath and partially within the base unit of another target assembly.

19 Claims, 5 Drawing Sheets

U.S. PATENT DOCUMENTS

| | | | | |
|---|---|---|---|---|
| 5,201,527 | A | 4/1993 | Koket | |
| D340,082 | S | 10/1993 | DeLapa | |
| 5,332,230 | A | 7/1994 | Benedict | |
| D363,953 | S | 11/1995 | Buse | |
| D375,125 | S | 10/1996 | Mallek et al. | |
| D375,530 | S | 11/1996 | Rudd | |
| 5,765,832 | A | 6/1998 | Huff | |
| 5,871,216 | A | 2/1999 | Sparacino | |
| 5,909,877 | A | 6/1999 | Bour | |
| 6,244,598 | B1 | 6/2001 | Conville | |
| 6,749,201 | B2 * | 6/2004 | Kessler, Jr. et al. | 273/400 |
| 6,932,345 | B1 | 8/2005 | O'Dell | |
| 2002/0079645 | A1 | 6/2002 | Brown | |
| 2005/0023762 | A1 | 2/2005 | Greiwe et al. | |
| 2005/0127609 | A1 | 6/2005 | Raslowsky | |

OTHER PUBLICATIONS

"Softshoes backyard cornhole bean bag games!," printed from the internet at http://www.whetstoneproducts.com/ on Jan. 20, 2006, (6 pages).

"Windy City Bags dot com," printed from the Internet at http://www.windycitybags.com/ on Jan. 20, 2006, (7 pages).

"Welcome to SuperSackToss.com," printed from the Internet at http://www.supersacktoss.com/ on Jan. 20, 2006, (2 pages).

"Corn Toss Games,", printed from the Internet at http://www.relcoproducts.com/ on Jan. 20, 2006, (1 page).

"Welcome to DG's Online Product Catalog,", printed from the Internet at http://www.drivewaygames.com/store/ on Jan. 20, 2006, (3 pages).

"Corntoss," printed from the Internet at http://www.corntoss.com/ on Jan. 20, 2006, (1 page).

"Woodgamz.com The Ultimate maker of Cornhole Products," printed from the Internet at http://www.woodgamz.com/cornholeboards.html on Jan. 20, 2006 (3 pages).

"Baggo The Official Bag Toss Game," printed from the Internet at http://www.baggo.com/Pages/SetUp.asp on Jan. 20, 2006 (2 pages).

"Mr. Mom's, Inc. Fiberglass Corn Toss Game," printed from the Internet at http://www.corntoss.net/ on Jan. 20, 2006 (8 pages).

* cited by examiner

BAG TOSS GAME TARGET ASSEMBLIES

FIELD OF THE INVENTION

The present invention relates to target assemblies for bag toss games and, more particularly, to bag toss game target assemblies having decks that are releasably engageable with supporting base units.

BACKGROUND OF THE INVENTION

Bag toss games have been played in the United States for many years. In most bag toss games, players take alternating turns attempting to toss a plurality of sealed bags (typically four bags for each player) containing particulate matter (e.g., dried corn, beans, rice, sand, plastic beads, etc.), one at a time, through an opening or hole in a fixed target assembly that is resting on the ground a predetermined distance away from the player. Typically, two spaced apart target assemblies are used, and each features a deck that is angled slightly toward the player with respect to the ground on which the target assembly is resting.

Bag toss games can be played using a variety of rules. Most rules award players a plurality of points for every bag that is tossed or knocked entirely through the hole in the deck of the target assembly, a lesser amount of points for bags that remain on the deck but do not pass entirely through the hole in the deck, and no points for bags that do not pass through the hole in the deck or remain on the deck after all of the bags have been tossed. Games are usually played until one of the players or a team of two players accumulates sufficient points to reach a predetermined goal.

Traditional bag toss game target assemblies constitute unitary, rigid structures constructed from ½" to ¾" plywood. A bag toss game that is popular in the Cincinnati, Ohio area, which is known as "Cornhole" or "Corn Toss", features target assemblies constructed of painted plywood that consist of a deck that is permanently attached to wooden support structure such as plywood and/or 2"×4" studs. An organization known as the American Cornhole Association ("ACA") has adopted standards that specify that the target assemblies (which are sometimes referred to as "platforms") used in that particular bag toss game should have a flat deck that is 24" wide, 48" long and have a single 6" circular hole or opening through the deck centered between the sides of the deck approximately 9" from a raised rear portion of the deck. Due to the dimensions and the materials used, bag toss game target assemblies of this type tend to be very heavy and bulky, which makes them difficult to transport, store and expensive to ship.

In recent years, bag toss game target assemblies have appeared on the market that feature folding rear legs. When extended, the rear legs support the rear of the deck at higher elevation than the front of the deck, which is resting on the ground. When folded, the rear legs are disposed against the underside of the deck, which minimizes the thickness dimension of the target assembly. In some instances, two bag toss game target assemblies of this type can be joined together when the rear legs are folded against the underside of the deck and carried like a very large briefcase. Bag toss game target assemblies of this type can be formed of wood or plastic. The configuration of these bag toss game target assemblies makes them more transportable than other types of target assemblies, but it also makes them less stable. Furthermore, since the front portion of the deck rests on or very close to the ground, tossed bags that land on the ground in front of the target assemblies can bounce onto the decks, which is a violation of most bag toss game rules.

SUMMARY OF THE INVENTION

Bag toss game target assemblies according to the present invention comprise a deck and a base unit. The deck has a front end, a rear end, a top surface and includes at least one through-aperture dimensioned to allow a bag to pass entirely therethrough. The base unit has a bottom portion that is configured to rest on a generally horizontal surface and a top portion that is configured to support the deck during game play such that the top surface of the deck is maintained at an incline with respect to the generally horizontal surface on which the bottom portion of the base unit is resting, with the front end of the deck maintained above but closer to the generally horizontal surface than the rear end of the deck. In one preferred embodiment, the base unit further comprises an open-top storage receptacle that is covered by the deck when the deck is supported by the top portion of the base unit during game play, but which can be accessed by moving at least a portion of the deck away from the top portion of the base unit. In another preferred embodiment, the deck from at least one target assembly can be removed from its corresponding base unit, and the corresponding base unit can be nested beneath and partially within the base unit of another target assembly. Bag toss game target assemblies according to the present invention are lighter in weight and more compact than most conventional bag toss game target assemblies, making them easier to transport and store. In addition, bag toss game target assemblies according to the invention are more stable and durable than prior art bag toss game target assemblies having folding legs.

The foregoing and other features of the invention are hereinafter more fully described and particularly pointed out in the following description, which sets forth in detail certain illustrative embodiments of the invention, these being indicative, however, of but a few of the various ways in which the principles of the present invention may be employed.

DETAILED DESCRIPTION OF THE PREFERRED EMBODIMENTS

Figure 1:
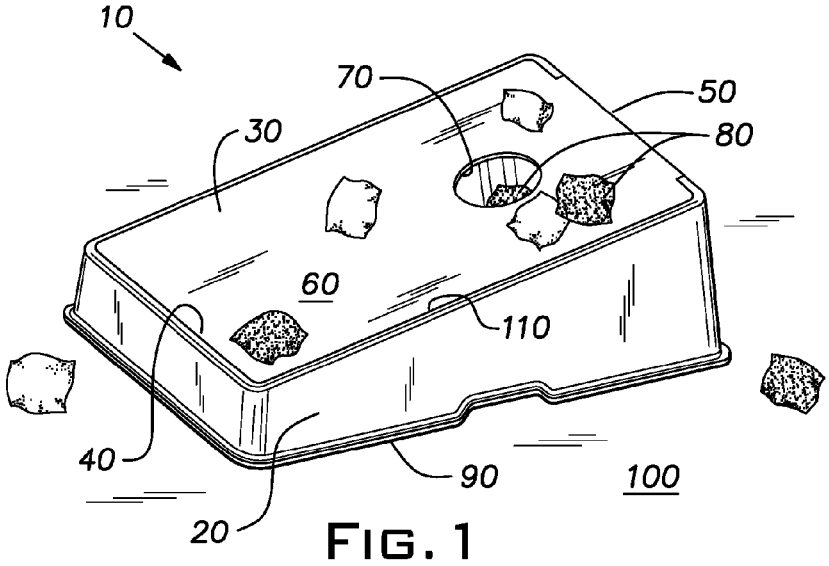
FIG. 1 is a perspective view of the presently most preferred embodiment of a bag toss game target assembly according to the invention as it would appear during game play.

With reference to FIG. 1, a bag toss game target assembly 10 according to the invention generally comprises a base unit 20 and a deck 30. The deck 30 has a front end 40, a rear end 50 and a top surface 60. The deck also includes at least one through-aperture 70 dimensioned to allow a bag 80 to pass entirely therethrough.

The deck is preferably a unitary structure. It should be substantially rigid, meaning that it should not flex or deflect substantially when a bag 80 lands on the top surface 60 of the deck 30 during game play. The thickness of the deck is not per se critical, but a deck having a thickness of about 0.5 inch is presently considered optimal. The top surface of the deck is preferably planar, but the top surface can be crowned slightly in the center to improve rigidity. The top surface of the deck should be sufficiently smooth that toss bags can slide thereon, but not so smooth that bags cannot come to rest on the deck.

In the presently most preferred embodiment of the invention, the deck is made of plywood, which makes target assemblies according to the invention exhibit the same play characteristics as traditional target assemblies that have decks made of plywood. However, decks can also be made of other rigid materials such as, for example, wood containing laminates. Medium density fiberboard ("MDF") can also be used, but MDF tends to add considerable weight and is not as dimensionally stable as plywood. Furthermore, MDF can be difficult to finish, the edges are somewhat prone to being damaged, and MDF sometimes releases a formaldehyde odor when confined, heated spaces such as the trunks of automobiles. The deck can be made of other rigid materials including, for example, polyethylene and other polymers, fiberglass and light metals.

The top surface of the deck is particularly suitable for the application of decorative graphics such as, for example, advertising and/or logos from colleges and athletic teams. The top surface can be decorated with graphical images using a variety of decorating technique such as, for example, screen-printing, painting, decals, transfer printing and sublimation printing.

The length and width dimensions of the deck are not per se critical. If desired, the deck can be sized to provide a playing surface having a total width of about 24" and a length of about 48" (the playing surface consists of the exposed top surface of the deck and any framing lying in the same plane as defined by the top surface of the deck that may surround the deck) to comply with the ACA standards. However, in the presently most preferred embodiment of the invention the deck is about 20.5" in width and about 32.25" in length (as is noted in greater detail below, in the presently most preferred embodiment of the invention, the deck is partially surrounded by a ¾" frame portion, and thus the overall playing surface consisting of the deck and the frame is about 22" in width and about 33" in length). A playing surface of this size is provides excellent game play, and is also compact enough to fit in the trunk of most automobiles.

The size, shape and location of the through-aperture(s) 70 in the deck 30 is also not critical, however the through-aperture 70 should be large enough to allow the bags 80 used during game play to pass entirely therethrough. In the preferred embodiment of the invention, one annular through-aperture 70 is formed in the deck 30, and that single annular through-aperture is centered on the longitudinal axis of the deck 30 nearer the rear end 50 of the deck than the front end 40 of the deck 30. In the presently most preferred embodiment of the invention, one annular through-aperture 70 is centered on the longitudinal axis of the deck about 8.5" from the rear end of the deck. It will be appreciated that a plurality of through-apertures could be formed at virtually any location the deck, if desired.

Bags traditionally used in bag toss games are square in shape and have sides measuring about 6" in length. Such bags are typically filled with up to about one pound of particulate matter (e.g., dried shelled corn or beans). Bags of this size need a through-aperture that is at least 6" in diameter. The through-aperture 70 can be slightly larger than 6" for a bag of this size, if desired, but a through-aperture 70 that is significantly larger than the diameter of the bags 80 used in game play can make the game less interesting and competitive because it is relatively easy to toss a bag 80 through the through-aperture 70.

The through-aperture 70 is preferably no smaller than about 5" in diameter. Bags in the shape of squares having 5" sides are substantially smaller and have reduced mass as compared to square bags having 6" sides, which makes them more susceptible to being blown off course by relatively light winds. Bags in the shape of squares having 5.5" sides that are filled with about 10-11 ounces of particulate plastic fill material are presently most preferred, and are particularly suitable for use on decks having about a 5.75" annular through-aperture, which is also presently most preferred. The material used to form the bag is not per se critical, and a variety of fabrics and materials can be used. Knit polyester and cotton duck cloth are presently preferred.

Applicants have observed that degree to which the bag is filled is important. Bags that are filled too full disadvantageously tend to bounce off of the deck during game play more so than bags of the same size having less fill material in them. Preferably, the bags used in game play all weigh about the same weight, and are filled with the maximum amount of particulate material that still allows one to touch the tip of their middle finger and thumb together through the center of the bag (i.e., there is no particulate matter between the tip of the middle finger and thumb, only two layers of fabric). The minimum weight of the bag is preferably at least 8 ounces, and the maximum weight is preferably not greater than about 16 ounces.

The base unit 20 comprises a bottom portion 90 that is configured to rest on a generally horizontal surface 100. The generally horizontal surface 100 can be an outdoor surface such as, for example, a lawn, a street, a parking lot, a sidewalk, a beach or a patio. Alternatively, the generally horizontal surface 100 can be an indoor surface such as a floor or stage. The bottom portion 90 can constitute the ends of a plurality of legs that contact the generally horizontal surface 100, but in the presently most preferred embodiment of the invention, the bottom portion 90 comprises a substantially continuous (except for optional handles 280) bottom edge that contacts the generally horizontal surface 100 around the perimeter of the target assembly 10.

The base unit 20 also has a top portion 110 that is configured to support the deck 30 during game play such that the top surface 60 of the deck 30 is maintained at an incline with respect to the generally horizontal surface 100 on which the bottom portion 90 of the base unit 20 is resting, with the front end 40 of the deck 30 maintained above but closer to the generally horizontal surface 100 than the rear end 50 of the deck 30. The specific angle of the incline is not critical, but the incline should not be so severe that tossed bags slide off the front of the deck. The angle of the incline should allow the bags to come to rest on the deck after they have been tossed. However, the deck should be angled sufficiently that bags tossed onto the deck can stop sliding and come to rest before they slide off the back of the deck. A substantially planar deck that is pitched such that it inclines by about 2.0 to about 2.75 inches per foot from the front to the rear is typically suitable. In the presently most preferred embodiment of the invention, the top portion 110 of the base unit 20 supports the rear end 50 of the deck 30 about 11 inches above the substantially horizontal surface 100 and the front end 40 of the deck 30 about 4.4" above the substantially horizontal surface 100 (the decking being about 32.25" in length and thus having an increase in height of about 2.4" per foot from front to rear).

Figure 2:
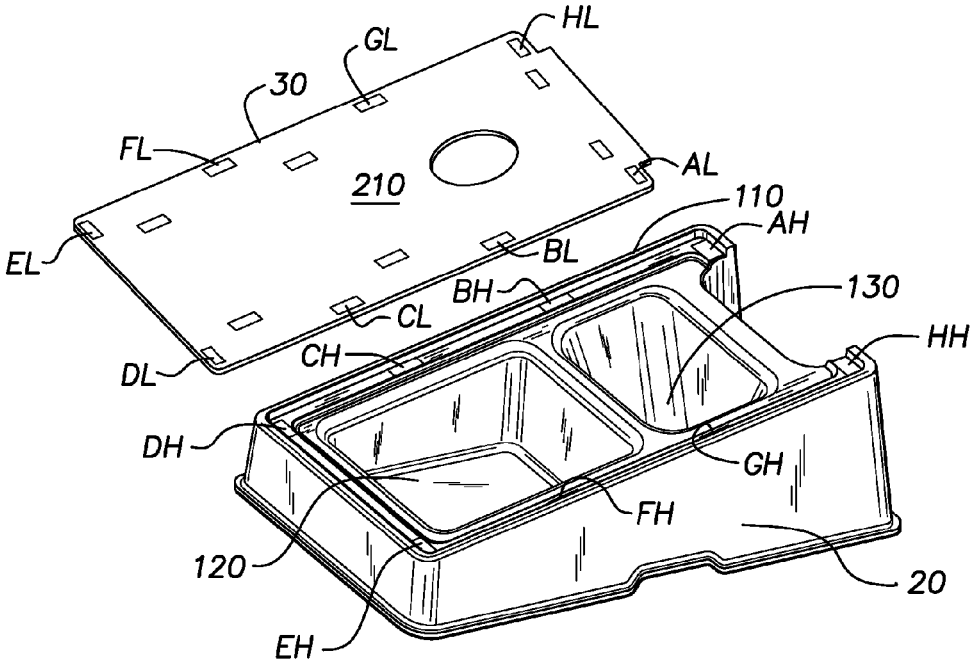
FIG. 2 is a perspective view of the bag toss game target assembly shown in FIG. 1 showing the deck moved away from the top portion of the base unit.
Figure 3:
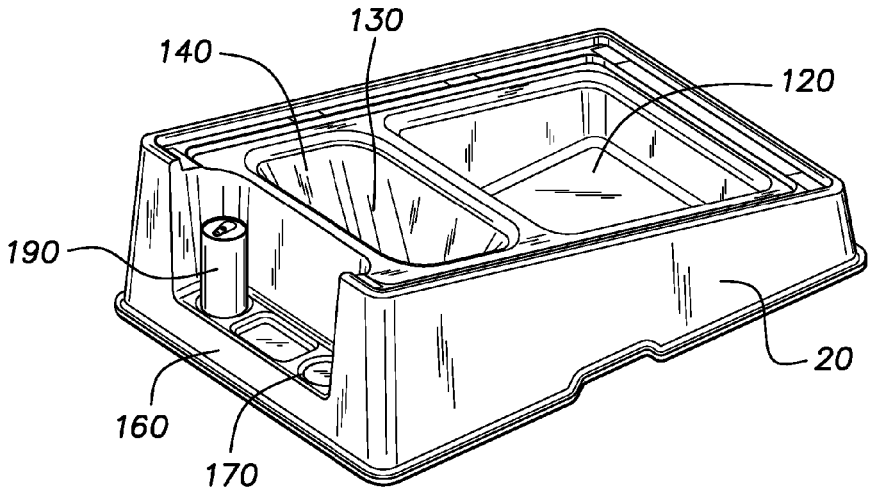
FIG. 3 is a view of the base unit shown in FIG. 2 taken from a perspective that shows a rear portion thereof.

The deck 30 is preferably releasably engageable with the top portion 110 of the base unit 20. With reference to FIGS. 2 and 3, in the presently most preferred embodiment of the invention the base unit 20 further comprises an open-top storage receptacle 120 that is covered by the deck 30 when the deck 30 is supported by the top portion 110 of the base unit 20 during game play, but which can be accessed by moving at least a portion of the deck 30 away from the top portion 110 of the base unit 20. The deck 30 can be configured to be completely removeable from the base unit 20 as illustrated in FIG. 2, or the deck 30 can be hingedly connected to the base unit 20 such that the deck 30 can be moved away from the top portion 110 of the base unit 20 to permit access to the open-top storage receptacle 120. The deck 30 can be hinged to the top portion 110 of the base unit 30 at the front end 40, the rear end 50 or on either of the opposing sides, if desired.

Completely removable decks are preferred over hinged decks inasmuch as completely removable decks allow for replacement decks to be engaged with the base unit as necessary or desired. Decks provided with special graphics (e.g., that commemorate particular events or display new advertising logos) can simply releaseably engaged with existing base units in place of the original decks. In addition, decks that are completely removable allow decks having through-apertures of varying size can be interchanged on the same base unit (e.g., decks having larger through-apertures can be installed for younger, inexperienced players, whereas decks having smaller through-apertures can be installed for more experienced players).

The open-top storage receptacle 120 is particularly useful for storing the bags 80 that are used during game play. However, it will be appreciated that the open-top storage receptacle 120 can be used store any matter that will fit therein. Preferably, the open-top storage receptacle 120 is dimensioned to allow at least two, and more preferably about twelve, sealed 12-ounce beverage vessels to be stored therein during game play. The open-top storage receptacle 120 is preferably water tight, allowing ice or gel packs to be placed into the open-top storage receptacle 120 with the plurality of beverage vessels. A drain plug can be included in a lower portion of the open-top storage receptacle 120, if desired, but a drain plug is generally not necessary in that the base unit 20 can simply be tipped over to empty any fluids and/or other unwanted matter from the open-top storage receptacle 120, if necessary. Alternatively, the open-top storage receptacle 120 can be used to hold an insulated cooler (e.g., a soft-walled insulating bag) containing sealed beverage vessels and/or other consumable items. Instead of an open-top storage receptacle 120, the base unit can be formed with structural supports for one or more small coolers, such as are commercially sold by the Igloo and Thermos corporations. During game play, players can move the deck 30 away from the top portion 110 of the base unit 20 and gain access to the open-top storage receptacle 120 therebeneath. Players can remove a beverage vessel or other matter from the open-top storage receptacle 120, and then move the deck 30 into position where it is supported by the top portion 110 of the base unit 20 to continue game play.

Some prior art bag toss game target assemblies, particularly those having folding rear legs, disadvantageously include open spaces between the sides of the deck and the ground on which the target assembly is resting. These open spaces sometimes permit tossed bags to come to rest underneath the deck without passing through the opening or hole in the deck. In addition, some prior art target assemblies include open space between the raised rear end of the deck and the ground on which the target assembly is resting. On occasion, a bag that has passed through the opening or hole in the deck can pass through the open space to the rear of the deck and come to rest on the ground a significant distance behind the target assembly. Bag toss games are sometimes played in low light conditions, and it is sometimes difficult for players to definitively determine whether a tossed bag actually passed through the opening or hole in the deck or whether it bounced under the deck or passed completely over the target assembly and landed on the ground behind the target assembly.

To alleviate these issues, the base unit 20 of the presently most preferred embodiment of a bag toss game target assembly 10 according to the invention further comprises an open-top bag receptacle 130 that is configured to reside beneath the through-aperture 70 in the deck 30 when the deck 30 is supported by the top portion 110 of the base unit 20 during game play. Each bag 80 that passes through the through-aperture 70 in the deck 30 is thus collected in the open-top bag receptacle 130 during game play. This makes it easy to confirm that the bag 80 did, in fact, pass through the through-aperture 70, even in low light conditions, and eliminates disputes regarding whether points should be awarded or not. It will be appreciated that the open-top bag receptacle 130 also prevents the bags 80 from contacting the ground and thus becoming soiled after they pass through the through-aperture 70 in the deck 30.

Figure 4:
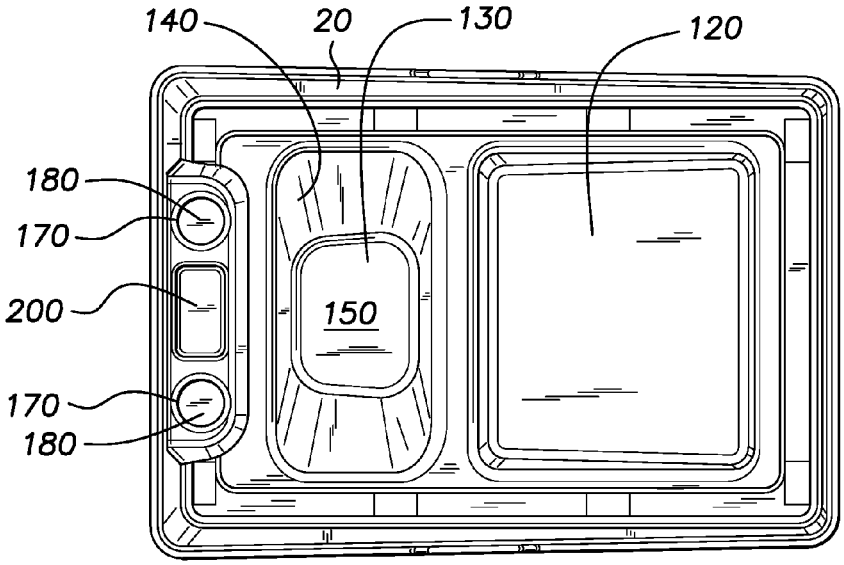
FIG. 4 is a top plan view of the base unit shown in FIG. 3.

In the presently most preferred embodiment of the invention, the open-top bag receptacle 130 features tapered side walls 140, which funnel the bags 80 to a central area 150 (shown in FIG. 4) directly beneath the through-aperture 70, making it easy for players to retrieve bags 80 that are collected in the open-top bag receptacle 130 without moving the deck 30 away from the top portion 110 of the base unit 20. The players simply reach through the through-aperture 70 and withdraw any bags 80 that may be in the open-top bag receptacle 130 by through the through-aperture 70 by hand. The open-top bag receptacle 130 is preferably dimensioned such that the total number of bags 80 used in the bag toss game (typically eight) can be collected therein below a plane defined by the top surface 60 of the deck 30 in the event that all of the bags 80 in a particular series of alternating tosses should pass entirely through the through-aperture 70 in the deck 30.

With reference to FIG. 3, in the presently most preferred embodiment of the invention a rear portion 160 of the base unit 20 includes a plurality of beverage holders 170, each having a bottom surface 180 for supporting a beverage vessel 190 (e.g., a 12-ounce beverage can, 12-ounce glass beverage bottle or a 0.5-liter plastic beverage bottle) placed thereon. Preferably two beverage holders 170 are formed in the rear portion 160 of the base unit 20. One or more trays 200 can be formed between the beverage holders 170 for holding small items such as, for example, coins, keys, cellular telephones and the like (see FIG. 4). The bottom surface 180 of the beverage holders 170 are preferably configured such that the beverage vessels 190 supported thereon are positioned underneath the deck 30 when the deck 30 is supported by the top portion 110 of the base unit 20 during game play. This prevents tossed bags 80 from striking the beverage vessels 190 during game play, which could cause them to tip over and spill the beverage contained therein.

The deck 30 can be supported by the top portion 110 of the base unit 20 using the force of gravity alone but, more preferably, the underside 210 of the deck 30 is releasably secured to the top portion 110 of the base unit 20 during game play using hook and loop fasteners. With reference to FIG. 2, the loop portion of the hook and loop fasteners is preferably attached to the underside 210 of the deck 30, and the mating hook portion of the hook and loop fasteners is preferably attached to the corresponding top portion 110 of the base unit 20. When several decks 30 are stacked on top of each other (e.g., during shipping), the loop material spaces the decks 30 apart slightly, protecting any graphics or indicia that may be applied thereto from scratching. It will be appreciated, however, that the opposite configuration could be used, if desired (i.e., the loop material could be attached to the base unit and the hook material attached to the underside of the deck).

A preferred arrangement of hook and loop fastening tabs is shown in FIG. 2, with reference symbols AL through HL representing tabs of loop material attached to the underside 210 of the deck 30 (e.g., through the use of adhesive and/or staples) and reference symbols AH through HH representing the corresponding tabs of hook material that mate with the respective tabs of loop material (AL mates with AH, BL mates with BH, etc). Hook and loop fasteners are preferred because, in addition to releasably securing the deck 30 to the top portion 110 of the base unit 20, they provide cushioning between the deck 30 and the base unit 20 that helps to absorb shock during game play, which minimizes noise and vibration of the deck 30 relative to the top surface 110 of the base unit 20 during game play. Rubber or cork (not shown) can be disposed between the deck 30 and the top portion 110 of the base unit 20 (alone or in addition to hook and loop fasteners) to absorb shock caused by the impact of bags 80 striking the top surface 60 of the deck 30 during game play.

Figure 5:
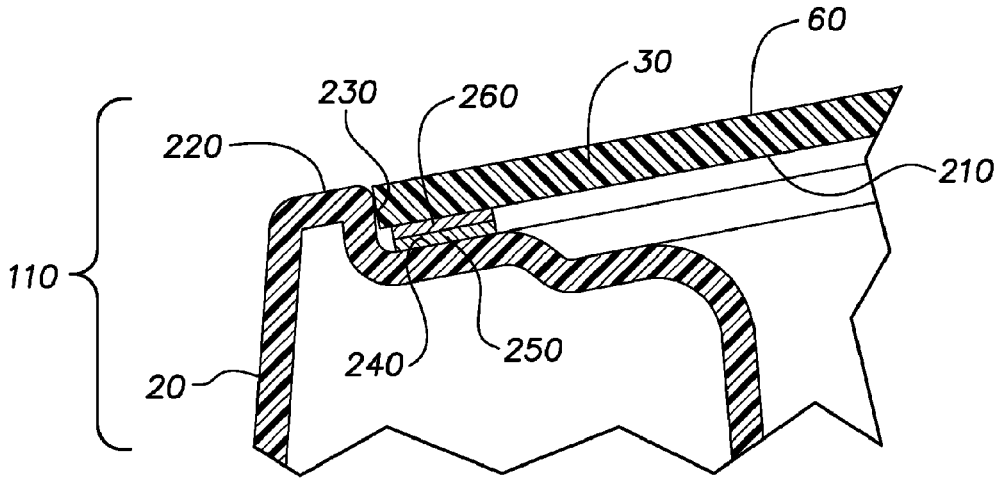
FIG. 5 is a section view showing a portion of bag toss game target assembly shown in FIG. 1, namely the portion where the front end of the deck is supported by the corresponding top portion of the base unit.

With reference to FIG. 5, in the presently most preferred embodiment of the invention the top portion 110 of the base unit 20 comprises a frame portion 220 that at least partially surrounds the deck 30 and thus keeps the deck 30 properly positioned on the top portion 110 of the base unit 20. A vertical sidewall 230, which is preferably about the same height as the thickness dimension of the deck 30, extends downwardly from the inner side of the frame portion 220 and terminates in a relatively flat rim portion 240. The hook portion 250 of hook and loop fasteners can be secured to the rim portion 240 (e.g., using adhesive and/or rivets), and the loop portion 260 of the hook and loop fasteners can be secured to the underside 210 of the deck 30 at the corresponding perimeter locations to releasably secure the deck 30 to the top portion 110 of the base unit 20. Preferably, the top surface of the frame portion 220 lies in the same general plane as defined by the top portion 60 of the deck 30 (i.e., there is no step up or down in height at the transition between the top surface 60 of the deck 30 and the frame portion 220 of the base unit 20). Thus the frame portion 220 and the top surface 60 of the deck 30 together constitute a playing surface that can support tossed bags 80 during game play.

It will be appreciated that the deck 30 can be releasably secured to the top portion 110 of the base unit 20 using means other than hook and loop fasteners. For example, openings or depressions (not shown) can be formed in the vertical sidewall 230 of the top portion 110 of the deck 30, and spring-loaded detents (not shown) can be provided in the edges of the deck to engage with the openings or depressions. The detents can also be formed in the vertical sidewall 230 of the top portion 110 of the base unit 20 to engage with openings or depressions (not shown) in the edges of the deck 30. Pins and other mechanical locking mechanisms can also be used. Preferably, the means for fastening the deck 30 to the top portion 110 of the base unit 20 does not require the use of tools to remove the deck 30 from the base unit 20.

Although a frame portion 220 is preferred, it is not required. It will be appreciated that the deck can be configured to completely cover the top portion of the base unit, making a frame portion 220 unnecessary. A deck of this type could fit onto the top portion of the base unit in a manner similar to a lid on a plastic tote. The deck could form a "snap-fit" engagement with the top portion of the base unit, or could be mechanically secured to the top portion of the base unit. Alternatively, the deck could fit in or onto, yet cover, the top portion of the base unit in a manner similar to a lid on a cooking pot. It will be appreciated that the manner in which the deck is supported by the top portion of the deck is not per se critical, and a variety of means can be employed within the scope of the invention.

Figure 6:
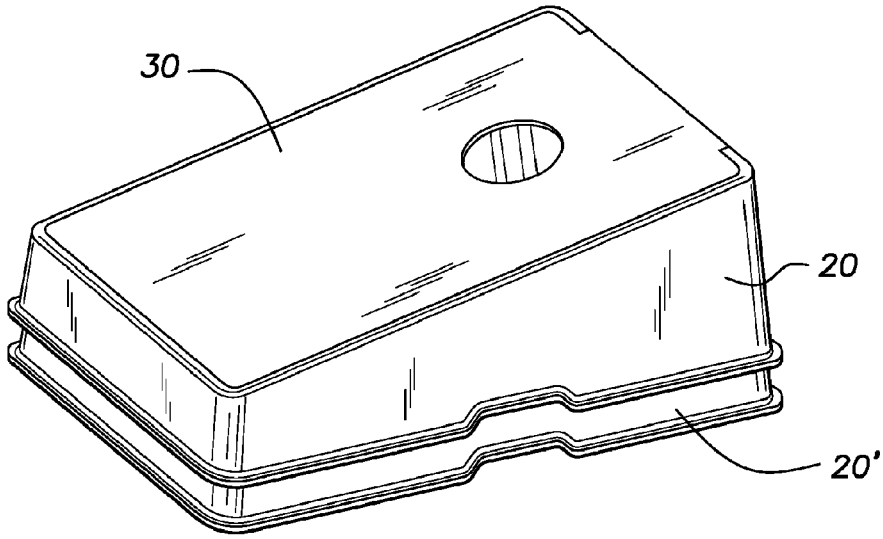
FIG. 6 is a perspective view of two bag toss game target assemblies according to the invention in a nested configuration.

In a preferred embodiment of the invention, the deck of one target assembly can be removed from the top portion of its corresponding base unit, and the deck-less corresponding base unit 20' can then be nested beneath and at least partially within the base unit 20 of another target assembly, as shown in FIG. 6. To facilitate nesting, the bottom portion 90 of the base unit 20 can be flared out slightly from the top portion 110.

Target assemblies 10 according to the invention are generally used in pairs, and a pair of nested target assemblies 10 according to the invention is more compact and thus easier to transport and store than a pair of target assemblies 10 that are not nested together. It will be appreciated that only the bottom-most target assembly in the pair of nested target assemblies needs to be configured such that its corresponding deck can be removed from its corresponding base unit 20' in order to allow the corresponding base unit 20' to be nested beneath and at least partially within the base unit 20 of the other target assembly. However, it is preferable for both the top-most and bottom-most target assemblies in the pair of nested target assemblies to be substantially the same size and shape, and for the decks of both of the pair of target assemblies to be removable. The pair of nested target assemblies can thus be transported and stored in a lightweight carry bag, with the bags 80 used during game play being stored in the open-top storage receptacle 120 of the top-most base unit 20 in the nested pair.

Figure 7A:
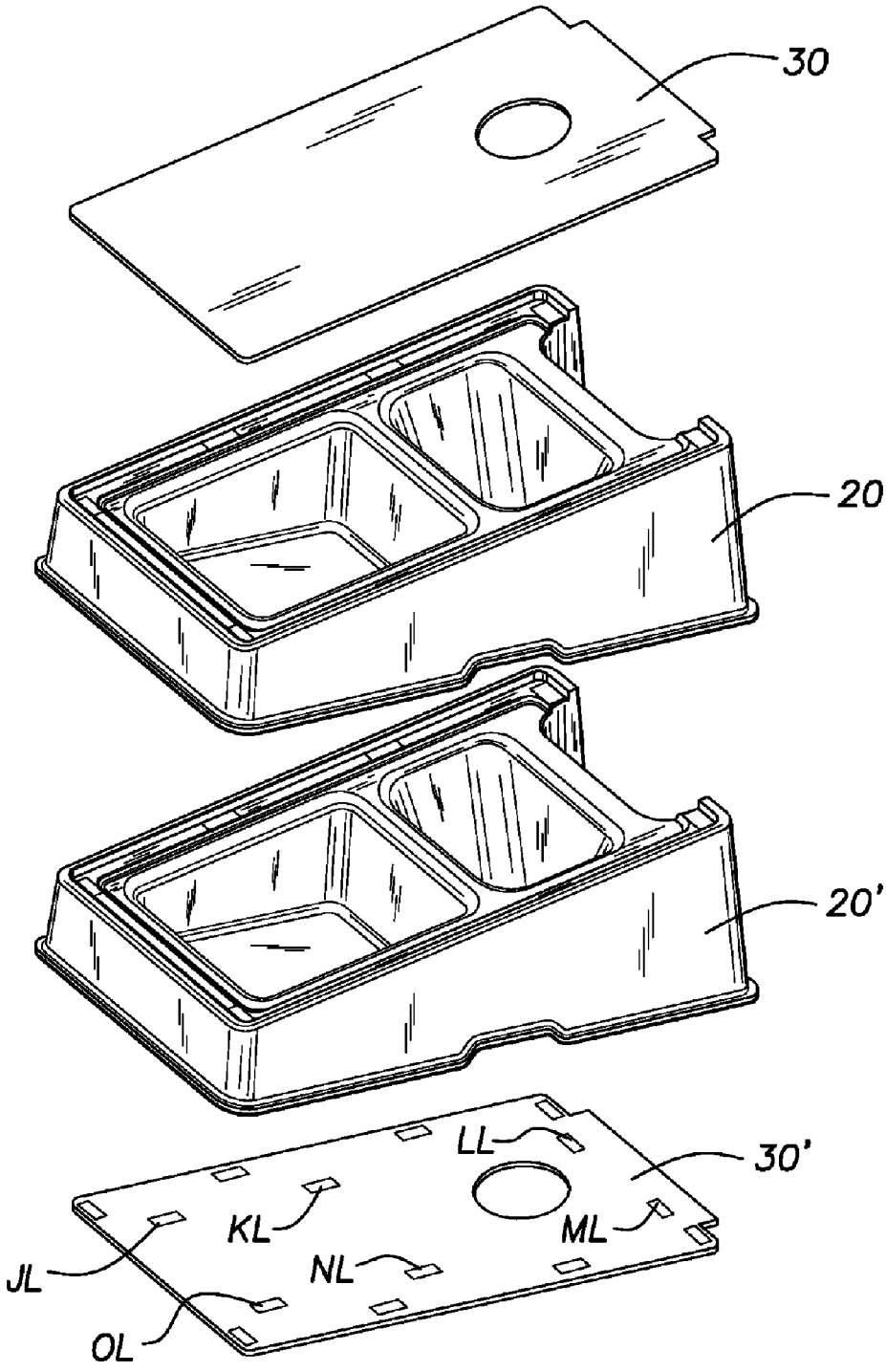
FIG. 7A is an exploded perspective view taken from above of the two target assemblies shown in FIG. 6.
Figure 7B:
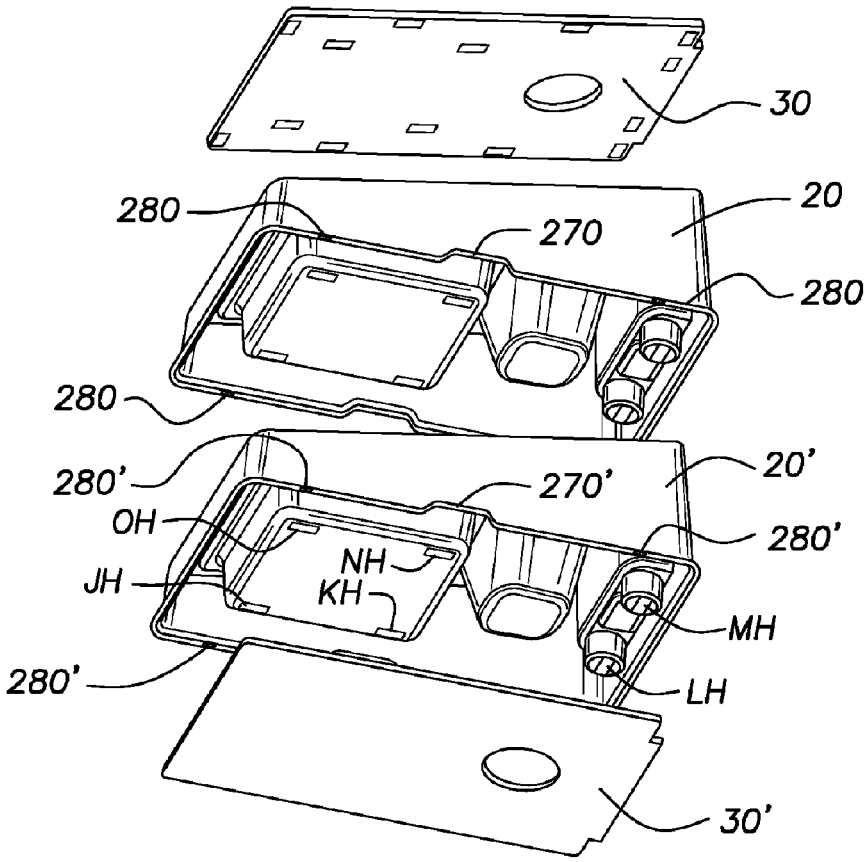
FIG. 7B is an exploded perspective view taken from below of the two target assemblies shown in FIG. 6.
Figure 7C:
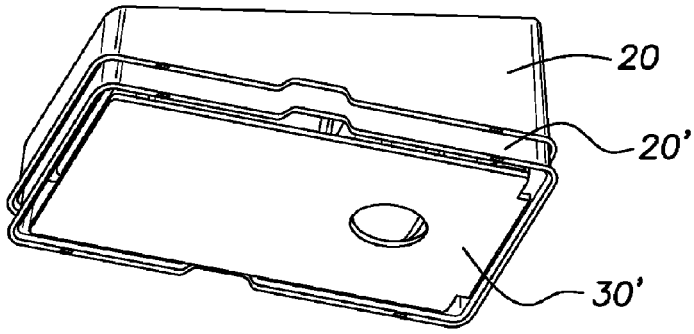
FIG. 7C is a perspective view taken from below of the nested target assemblies shown in FIG. 6.

FIGS. 7A and 7B show exploded perspective views, from above and below, respectively, of a first base unit 20 and its corresponding deck 30 and a second base unit 20' and its corresponding deck 30'. At least the underside of the deck 30' is provided with loop tabs of hook and loop fasteners for securing the deck 30' to the underside of the base unit 20'. The preferred arrangement of the loop tabs is shown on the underside of the deck 30' in FIG. 7A using reference symbols JL through OL. The corresponding hook tabs of hook and loop fasteners are secured to the underside of the base unit 20', preferably under the open-top storage receptacle 120 and the underside of the bottom surface 180 of the cup holders 170 as shown in FIG. 7B using corresponding reference symbols JH through OH (JL mates with JH, KL mates with KH, etc.).

In the presently most preferred embodiment of the invention, the undersides of the open-top storage receptacle 120 and the underside of the bottom surface 180 of the cup holders 170 are in the same plane, which is parallel to a plane defined by the bottom portion 90 of the base unit 20. The underside of the open-top storage receptacle 120 and the underside of the bottom surface 180 of the cup holders 170 are preferably recessed upwardly from the bottom portion of the base unit a distance at least as great as the thickness of the deck 30', which allows the top portion 60 of the deck 30' to be in the same plane as the bottom portion 90 of the base unit 20' when the deck 30' is secured to the underside of the base unit 30'.

FIG. 7B also shows optional handles 270, 270', which are preferably formed proximal to the bottom portion 90 of side of the base unit 20. The handles 270, 270' make it easy to lift the base units 20, 20' off the generally horizontal surface 100. The handles 270, 270' also make it easy to separate the top-most base unit 20 from base unit 20' nested beneath it. FIG. 7B also shows optional rubber pads 280, 280', which can be attached to the bottom portion 90 of the base unit 20, 20' to prevent the base units 20, 20' from sliding on smooth surfaces such as wooden gymnasium floors, linoleum floors, and the like.

It will be appreciated that more than two base units according to the invention can be nested together at the same time. In some applications, such as when large numbers of target assemblies are to be used simultaneously in intramural sports programs, in tournaments or in physical education courses, it is advantageous to nest a plurality (e.g., a dozen or more) of base units together in a stack. The base units can be stacked on a cart together with a container of bags and a vertical or horizontal stack of an accompanying number of decks. The cart, which can be provided with hard rubber or pneumatic wheels, can be rolled to and from a gymnasium, a multi-purpose room, or an athletic field to allow for quick set up and removal of the plurality of target assemblies.

The base unit is preferably formed of molded plastic and comprises a unitary (one-piece) structure. The presently most preferred plastic is high-density polyethylene. Other suitable molding resins include polystyrene, polyurethane, nylon, ABS, polypropylene and blends of two or more polymers. The base unit can be formed using a variety of molding processes including, for example, vacuum thermoforming, blow molding, rotational molding and injection molding, with injection molding being presently most preferred.

The wall thickness of the base unit must be sufficient that the base unit provides rigid support for the deck, but in view of weight and costs considerations, the wall thickness should be the minimum thickness necessary to provide support for the deck. When the base unit is formed of injection molded high-density polyethylene, a wall thickness of about 0.100 inches is presently believed to be sufficient. Thicker wall thicknesses may be necessary for other molding processes. The plastic used to form the base can be colored to match and/or to coordinate with any graphical decorations that may be applied to the playing surface of the deck.

Less preferably, the base unit can also be formed of light metals such as aluminum (e.g., by stamping or casting), wood and/or a combination of materials, either as a single structure or as a plurality of individual components that are joined together to form a single structure. However, in view of manufacturing expediency and cost, molded plastic base units are preferred.

Preferably, the base unit does not have any moving parts exclusive of optional score keeping devices. Suitable optional score keeping devices include, for example, incrementally moveable tabs or clips that can be selectively positioned adjacent to indicia provided on the deck or base unit. Alternatively, pointers or dials that can be selectively rotated with reference to indicia provided on the deck or base unit can also be used to keep track of the score of the game. Bag toss games proceed at a relatively fast pace, and usually no scoring device is needed. Devices that have been used with traditional bag toss game target assemblies can also be used (e.g. retractable measuring tapes or cords that allow the target assemblies to be spaced apart a predetermined distance).

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A bag toss game target assembly comprising:

a deck having a front end, a rear end and a top surface, wherein the deck includes at least one through-aperture dimensioned to allow a bag to pass entirely therethrough; and a base unit having a bottom portion configured to rest on a generally horizontal surface, a top portion configured to support the deck during game play such that the top surface of the deck is maintained at an incline with respect to the generally horizontal surface on which the bottom portion of the base unit is resting, with the front end of the deck maintained above but closer to the generally horizontal surface than the rear end of the deck, and a storage receptacle that is covered by the deck and thereby rendered completely inaccessible when the deck is supported by the top portion of the base unit during game play, but which can be accessed by moving at least a portion of the deck away from the top portion of the base unit, the storage receptacle being dimensioned sufficient to store at least two 12-ounce beverage vessels therein during game play such that said at least two 12-ounce beverage vessels are not in contact with the generally horizontal surface on which the bottom portion of the base unit is resting.

2. The bag toss game target assembly according to claim 1 wherein a rear portion of the base unit includes a plurality of beverage holders each having a bottom surface for supporting a beverage vessel placed thereon such that the beverage vessel is positioned underneath the deck when the deck is supported by the top portion of the base unit during game play.

3. The bag toss game target assembly according to claim 1 wherein the base unit further comprises an open-top bag receptacle separate and apart from the storage receptacle, wherein the open-top bag receptacle is configured to reside beneath the through-aperture in the deck when the deck is supported by the top portion of the base unit during game play to collect one or more bags that may pass entirely therethrough.

4. The bag toss game target assembly according to claim 1 wherein the base unit is a unitary structure formed of molded plastic.

5. The bag toss game target assembly according to claim 1 wherein the deck is formed of plywood.

6. The bag toss game target assembly according to claim 1 wherein the deck is releasably secured to the top portion of the base unit during game play using hook and loop fasteners.

7. A plurality of bag toss game target assemblies, each target assembly comprising:

a deck having a front end, a rear end and a top surface, wherein the deck includes at least one through-aperture dimensioned to allow a bag to pass entirely therethrough; and a base unit having a bottom portion configured to rest on a generally horizontal surface, and a top portion configured to support the deck during game play such that the top surface of the deck is maintained at an incline with respect to the generally horizontal surface on which the bottom portion of the base unit is resting, with the front end of the deck maintained above but closer to the generally horizontal surface than the rear end of the deck;

wherein, the deck of at least a first one of the plurality of target assemblies can be removed from the top portion of its corresponding base unit to allow said corresponding base unit to be nested beneath and at least partially within the base unit of a second one of the plurality of target assemblies when the base unit of the first one of the plurality of target assemblies and the base unit of the second one of the plurality of target assemblies are in the same orientation.

8. The plurality of bag toss game target assemblies according to claim 7 wherein each base unit that is nestable beneath and at least partially within the base unit of another of the plurality of target assemblies further comprises a storage receptacle that is covered by the deck and thereby rendered completely inaccessible when the deck is supported by the to portion of the base unit during game play, but which can be accessed by moving at least a portion of the deck away from the top portion of the base unit, the storage receptacle being dimensioned sufficient to store at least two 12-ounce beverage vessels therein during game play such that said at least two 12-ounce beverage vessels are not in contact with the generally horizontal surface on which the bottom portion of the base unit is resting.

9. The plurality of bag toss game target assemblies according to claim 7 wherein a rear portion of each base unit includes a plurality of beverage holders each having a bottom surface for supporting a beverage vessel placed thereon such that the beverage vessel is positioned underneath the deck when the deck is supported by the top portion of the base unit during game play.

10. The plurality of bag toss game target assemblies according to claim 7 wherein each base unit further comprises an open-top bag receptacle separate and apart from the storage receptacle, wherein the open-top bag receptacle is configured to reside beneath the through-aperture in the deck when the deck is supported by the top portion of the base unit during game play to collect one or more bags that may pass entirely therethrough.

11. The plurality of bag toss game target assemblies according to claim 7 wherein each base unit is a unitary structure formed of molded plastic.

12. The plurality of bag toss game target assemblies according to claim 7 wherein each deck is formed of plywood.

13. The plurality of bag toss game target assemblies according to claim 7 wherein each deck is releasably secured to the top portion of its corresponding base unit during game play using hook and loop fasteners.

14. A pair of bag toss game target assemblies, each target assembly comprising:

a deck having a front end, a rear end and a top surface, wherein the deck includes at least one annular through-aperture dimensioned to allow a bag to pass entirely therethrough, said annular through-aperture being centered on a longitudinal axis of the deck nearer the rear end of the deck than the front end of the deck; and a molded plastic base unit having a bottom portion configured to rest on a generally horizontal surface, a top portion configured to support the deck during game play such that the top surface of the deck is maintained at an incline with respect to the generally horizontal surface on which the bottom portion of the base unit is resting, with the front end of the deck maintained above but closer to the generally horizontal surface than the rear end of the deck, a rear portion including a plurality of beverage holders each having a bottom surface for supporting a beverage vessel placed thereon such that the beverage vessel is positioned underneath the deck when the deck is supported by the top portion of the base unit during game play, a storage receptacle that is covered by the deck and thereby rendered completely inaccessible when the deck is supported by the top portion of the base unit during game play, but which can be accessed by moving at least a portion of the deck away from the top portion of the base unit, the storage receptacle being dimensioned sufficient to store at least two 12-ounce beverage vessels therein during game play such that said at least two 12-ounce beverage vessels are not in contact with the generally horizontal surface, and an open-top bag receptacle separate and apart from the storage receptacle, wherein the open-top bag receptacle is configured to reside beneath the through-aperture in the deck when the deck is supported by the top portion of the base unit during game play to collect one or more bags that may pass entirely therethrough;

wherein each of the pair of target assemblies is substantially the same size and shape as the other, and wherein the deck of at least a first one of the pair of target assemblies can be removed from the top portion of its corresponding base unit to allow said corresponding base unit to be nested beneath and at least partially within the base unit of a second one of the pair of target assemblies when the base unit of the first one of the pair of target assemblies and the base unit of the second one of the pair of target assemblies are in the same orientation.

15. The pair of bag toss game target assemblies according to claim 14 wherein each deck is formed of plywood.

16. The pair of bag toss game target assemblies according to claim 14 wherein each deck is releasably secured to its corresponding base unit during game play using hook and loop fasteners.

17. The pair of bag toss game target assemblies according to claim 16 wherein the deck removed from the base unit of the first one of the pair of target assemblies that is nested beneath and at least partially within the base unit of the second one of the pair of target assemblies is releasably securable to an underside of its corresponding base unit using hook and loop fasteners.

18. The pair of bag toss game target assemblies according to claim 14 wherein the top portion of each base unit comprises:

a frame portion that at least partially surrounds the deck when the deck is supported by the top portion of the base unit during game play, and a vertical sidewall extending downwardly from an inner periphery of the frame portion to a relatively horizontal rim portion, with the deck being operatively supported by the rim portion of the top portion of the base unit.

19. The pair of bag toss game target assemblies according to claim 18 wherein the frame portion lies in a plane defined by the top portion of the deck.

* * * * *